US010103490B2

(12) United States Patent
Sugimoto

(10) Patent No.: US 10,103,490 B2
(45) Date of Patent: Oct. 16, 2018

(54) LEVER-TYPE CONNECTOR

(71) Applicant: Sumitomo Wiring Systems, Ltd., Yokkaichi, Mie (JP)

(72) Inventor: Shinpei Sugimoto, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/615,160

(22) Filed: Jun. 6, 2017

(65) Prior Publication Data

US 2017/0365953 A1 Dec. 21, 2017

(30) Foreign Application Priority Data

Jun. 17, 2016 (JP) ..... 2016-120562

(51) Int. Cl.
*H01R 13/629* (2006.01)
*H01R 13/642* (2006.01)
*H01R 13/50* (2006.01)

(52) U.S. Cl.
CPC ..... *H01R 13/642* (2013.01); *H01R 13/62938* (2013.01); *H01R 13/62961* (2013.01); *H01R 13/50* (2013.01); *H01R 13/6295* (2013.01); *H01R 13/62955* (2013.01); *H01R 13/62972* (2013.01)

(58) Field of Classification Search
CPC ..... H01R 13/62938; H01R 13/6295; H01R 13/62955; H01R 13/62961; H01R 13/62972; H01R 13/642
See application file for complete search history.

(56) References Cited

U.S. PATENT DOCUMENTS

2003/0166351 A1* 9/2003 Shinozaki ..... H01R 13/62938 439/157
2004/0097113 A1* 5/2004 Shinozaki ..... H01R 13/62938 439/157
2004/0097139 A1* 5/2004 Takada ..... H01R 13/41 439/733.1
2007/0072482 A1* 3/2007 Fujii ..... H01R 13/62938 439/489
2007/0207647 A1* 9/2007 Imai ..... H01R 13/62938 439/157

(Continued)

FOREIGN PATENT DOCUMENTS

JP 2013-161759 8/2013

*Primary Examiner* — Edwin A. Leon
*Assistant Examiner* — Oscar Jimenez
(74) *Attorney, Agent, or Firm* — Gerald E. Hespos; Michael J. Porco; Matthew T. Hespos

(57) ABSTRACT

A lever-type connector has a male housing (10) including a bottom wall (11) formed with through hole (23, 24) and a receptacle (12) extending forward from an outer periphery of the bottom wall (11). A female housing (30) is capable of fitting into the receptacle (12). A lever (33) is mounted on the female housing (30) and connects the male and female housings (10, 30) by being rotated from an initial position to a connection position. An arm (36) of the lever (33) is between an outer surface of the female housing (30) and an inner surface of the receptacle (12). First and second closing portions (40, 41) are on the arm (36) and are configured to close a clearance between an upper opening (13) of the receptacle (12) and the lever (33) by being above the through holes (23, 24) with the lever (33) at the connection position.

11 Claims, 14 Drawing Sheets

(56) References Cited

U.S. PATENT DOCUMENTS

| | | | | |
|---|---|---|---|---|
| 2008/0146067 | A1* | 6/2008 | Shinozaki | H01R 13/62938 439/345 |
| 2013/0252446 | A1* | 9/2013 | Forell | H01R 13/62938 439/157 |
| 2014/0315409 | A1* | 10/2014 | Hashimoto | H01R 13/62938 439/271 |
| 2014/0370733 | A1* | 12/2014 | Hashimoto | H01R 13/62938 439/157 |
| 2015/0004829 | A1 | 1/2015 | Aoki et al. | |
| 2015/0325950 | A1* | 11/2015 | Kamiya | H01R 13/62938 439/157 |
| 2016/0240969 | A1* | 8/2016 | Matsuura | H01R 13/62938 |
| 2016/0254618 | A1* | 9/2016 | Ludwig | H01R 13/62938 439/372 |
| 2016/0261069 | A1* | 9/2016 | Noro | H01R 13/62955 |
| 2017/0346221 | A1* | 11/2017 | Chikusa | H01R 13/62911 |
| 2017/0346222 | A1* | 11/2017 | Chikusa | H01R 13/62916 |
| 2017/0346223 | A1* | 11/2017 | Chikusa | H01R 13/62927 |
| 2017/0346224 | A1* | 11/2017 | Chikusa | H01R 13/62955 |
| 2017/0346227 | A1* | 11/2017 | Chikusa | H01R 13/62977 |

* cited by examiner

LEVER-TYPE CONNECTOR

BACKGROUND

1. Field of the Invention

The invention relates to a lever-type connector.

2. Description of the Related Art

Japanese Unexamined Patent Publication No. 2013-161759 discloses a lever-type connector with a first connector housing having a lever movably mounted thereon and a second connector housing. The second connector housing includes an outer tubular wall with an open front surface and a closing wall portion closing the back surface of the outer tubular wall. The first connector housing is accommodated into the outer tubular wall and the lever is rotated. As a result, a point-of-action projection formed on the lever is locked to a projection engaging protrusion formed on an inner wall surface of the outer tubular wall to connect the connector housings.

The projection engaging protrusion is locked to prevent the point-of-action projection from moving toward a front surface side of the outer tubular wall. Thus, the projection engaging protrusion faces a back surface side of the outer tubular wall. As a result, a penetrating mold removal hole is open on the closing wall to mold the projection engaging protrusion. Further, a projection guiding groove is formed in an area adjacent to the projection engaging protrusion out of the inner surface of the outer tubular wall and defines a movement path for causing the point-of-action projection to reach the projection engaging protrusion.

The projection guiding groove communicates with a mold removal space between the mold removal hole and the projection engaging protrusion. A pin-like external matter could enter the projection guiding groove from the front of the outer tubular wall, and could penetrate through the mold removal hole after passing through the mold removal space. A pin-like external matter that penetrates through the mold removal hole may contact a circuit board in proximity to or in contact with the back surface of the closing wall.

The invention was completed based on the above situation and aims to prevent the intrusion of an external matter.

SUMMARY

The invention is directed to a lever-type connector with a male housing that has a back wall formed with a through hole. A receptacle extends from an outer peripheral edge of the back wall toward a front end and a cam follower is formed on an inner surface of the receptacle. A female housing is capable of being fit into the receptacle. A lever is mounted on the female housing and is configured to connect the male housing and the female housing by being rotated from an initial position to a connection position while being engaged with the cam follower. An arm of the lever is arranged between an outer surface of the female housing and the inner surface of the receptacle. A closing portion is formed on the arm and is configured to close a clearance between a front opening of the receptacle and the lever by being arranged on a front surface side of the through hole when the lever is at the connection position.

The closing portion closes the clearance between the front opening of the receptacle and the lever so that external matter cannot intrude into the receptacle.

A receiving portion may project from the inner surface of the receptacle. A correcting projection may be formed on an outer surface of the arm and may be configured to correct the posture of the female housing with respect to the male housing by being locked to the receiving portion. The closing portion may be connected to the correcting projection. According to this configuration, the closing portion is connected to and reinforces the correcting projection.

The closing portion may be arcuate. The arcuate closing portion has enhanced rigidity and is excellent at reinforcing the correcting projection.

A mold removal groove may be formed in the inner wall surface of the receptacle to form the receiving portion, and the mold removal groove may communicate with the through hole. A guiding groove may be formed in the inner surface of the receptacle to communicate with the mold removal groove and defines a path for moving the correcting projection from the front opening of the receptacle toward a back of the receiving portion. The closing portion is accommodated in the guiding groove when the lever is at the connection position. An external matter intrusion path may be formed by the guiding groove and the mold removal groove and may extend from the front opening of the receptacle to the through hole. However, even if the arm is displaced slightly toward the front with respect to the receptacle when the lever is at the connection position, the closing portion is kept accommodated in the guiding groove. Therefore external matter cannot intrude into the receptacle can be prevented.

An end part of the arm most distant from a center of rotation of the arm may define an operating portion that is used to rotate the lever. A rib-like extending portion may be formed on an outer surface of the arm at a position adjacent to the closing portion and may extend toward the operating portion. Thus, the entire arm can be reinforced and the closing portion can be reinforced by the rib-like extending portion.

A communication groove may be formed in the inner surface of the receptacle and may allow communication between the front surface opening of the receptacle and the through hole, and the closing portion may be accommodated in the guiding groove with the lever at the connection position. According to this configuration, an external matter intrusion path extending from the front surface opening of the receptacle to the through hole may be formed by the communication groove. However, the closing portion remains in the communication groove even if the arm is displaced slightly toward the front surface with respect to the receptacle when the lever is at the connection position. Therefore, external matter cannot intrude into the receptacle.

DETAILED DESCRIPTION

Figure 1:
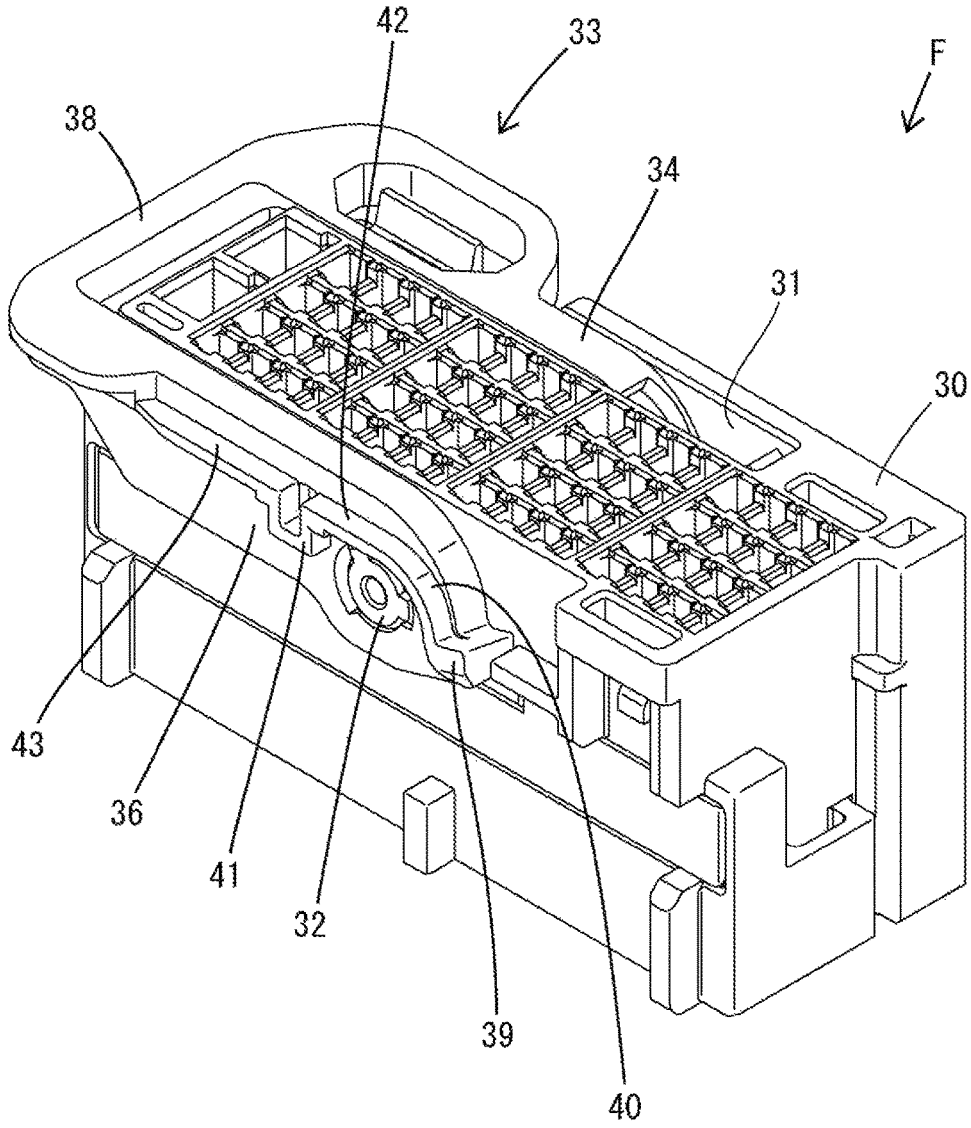
FIG. 1 is a perspective view of a female connector showing a state where a lever is at a connection position in one embodiment.
Figure 2:
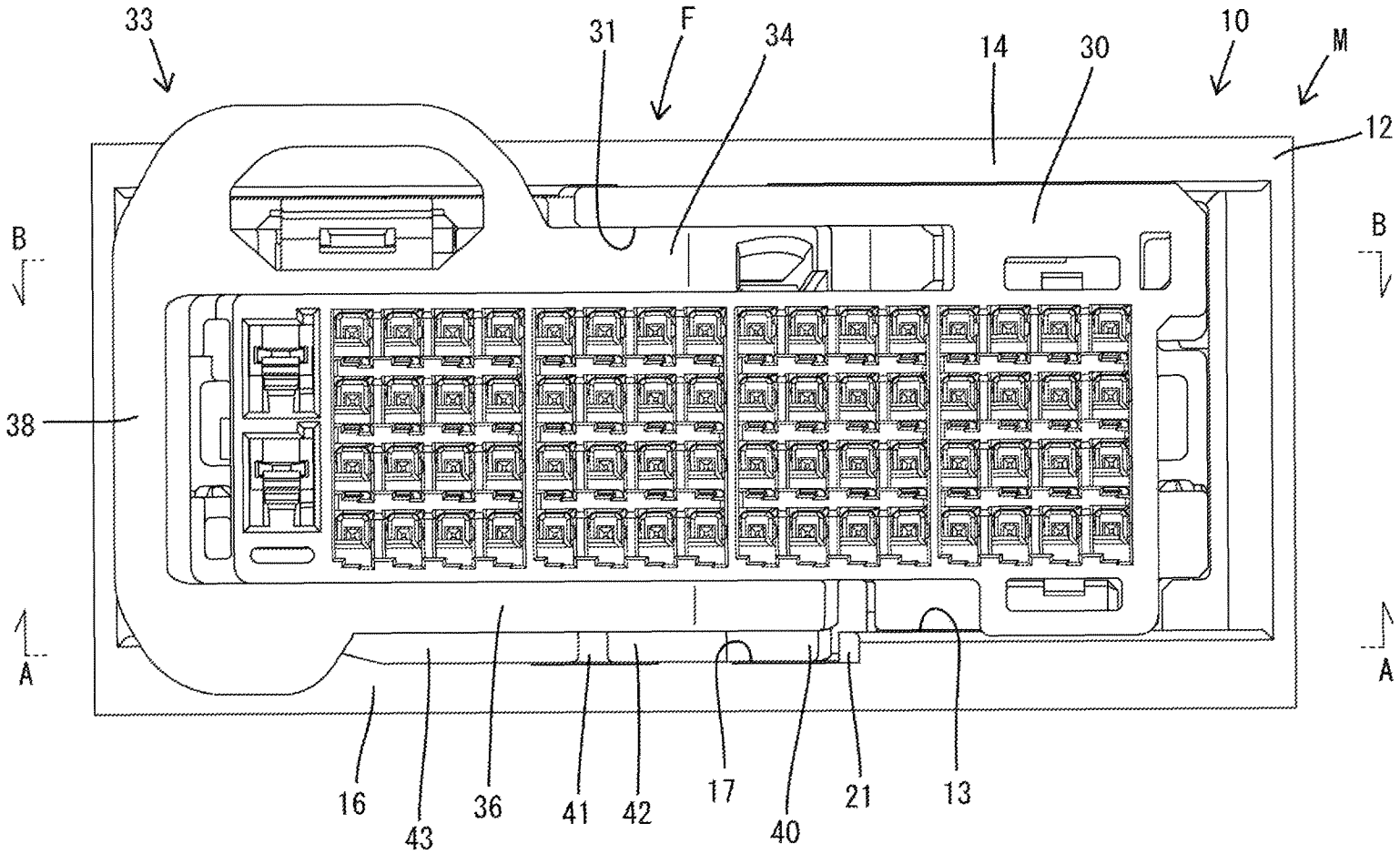
FIG. 2 is a plan view showing a state where a male connector and the female connector are properly connected by rotating the lever to the connection position.
Figure 3:
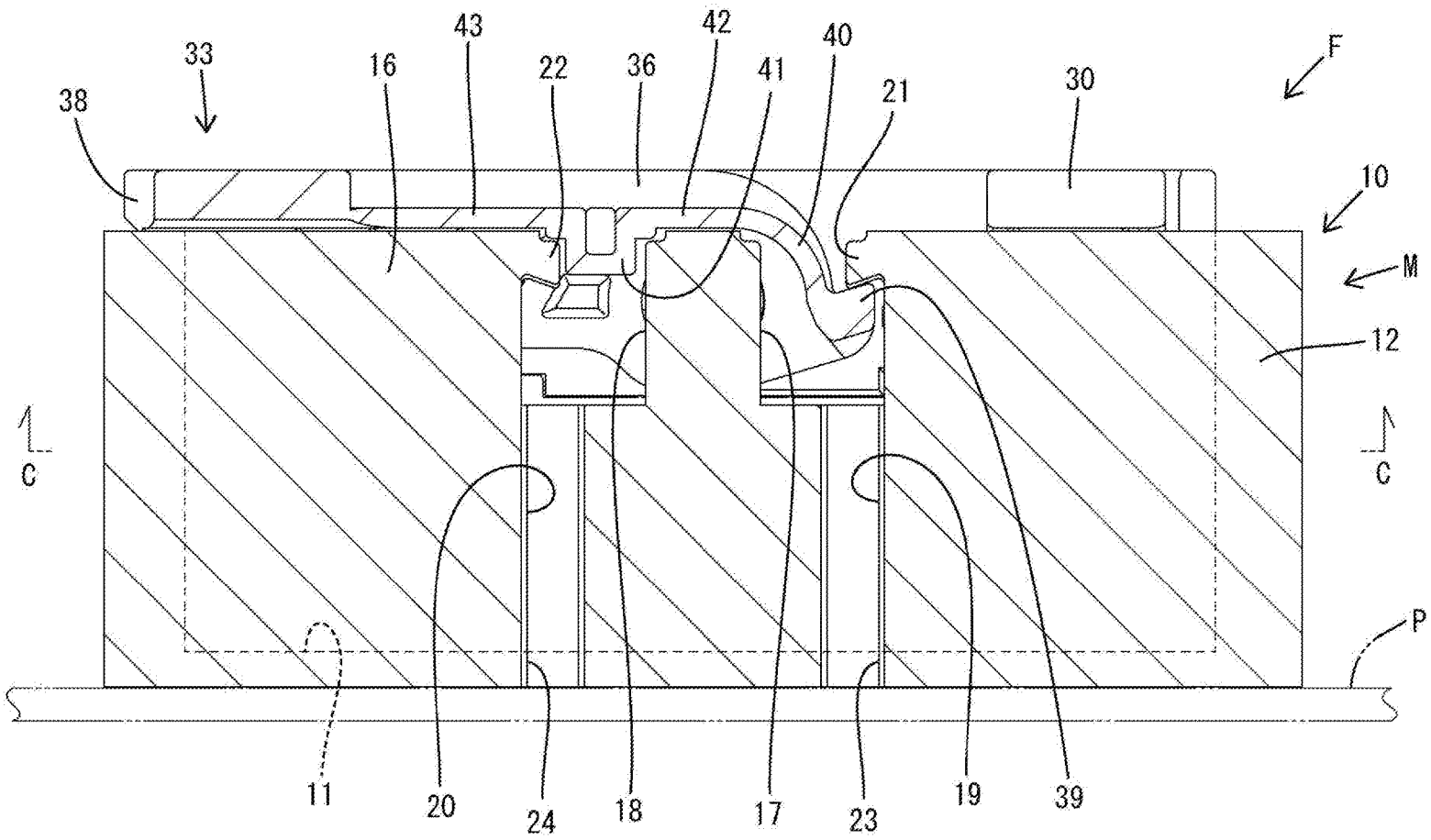
FIG. 3 is a section along A-A of FIG. 2.
Figure 4:
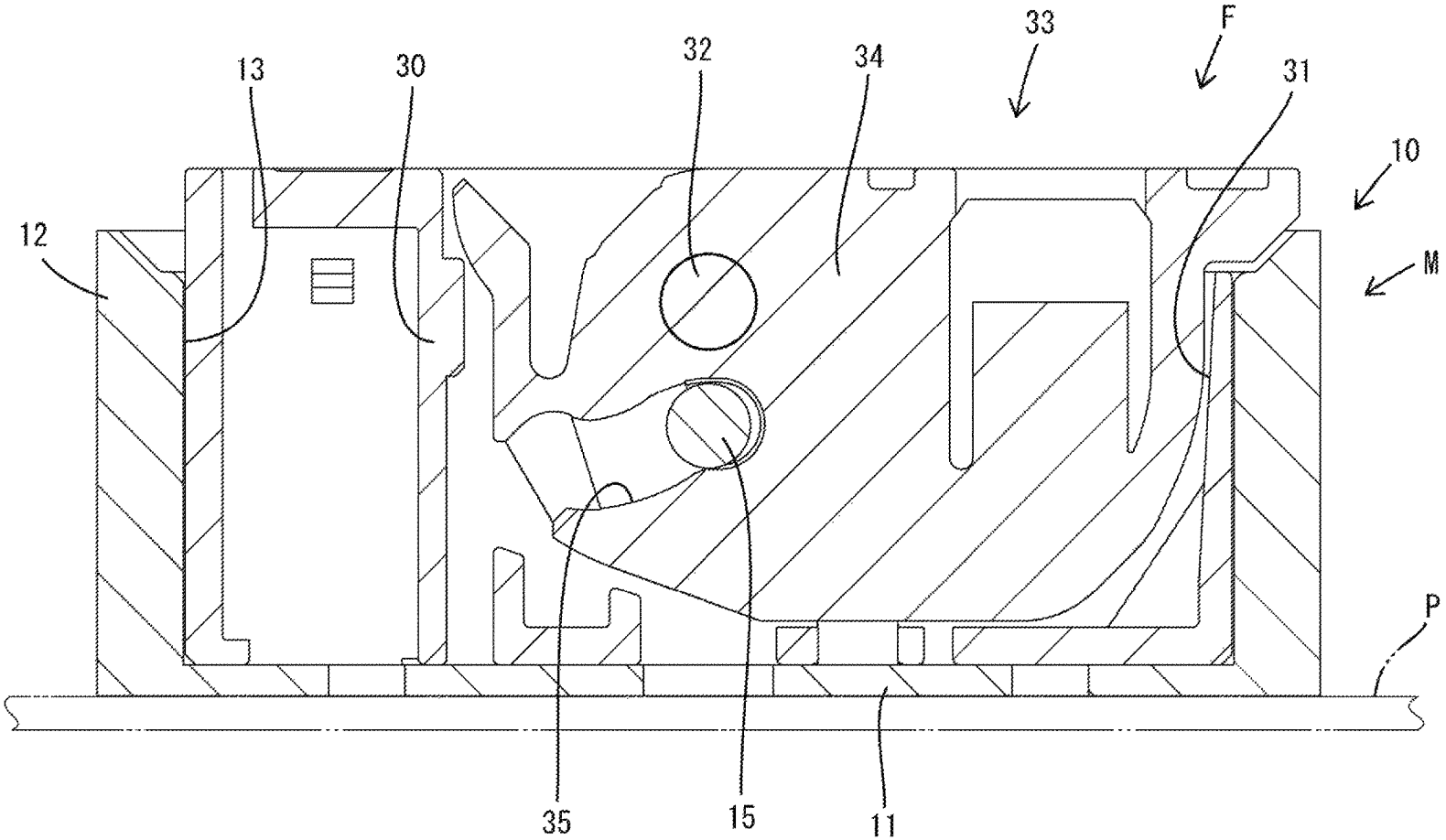
FIG. 4 is a section along B-B of FIG. 2.
Figure 5:
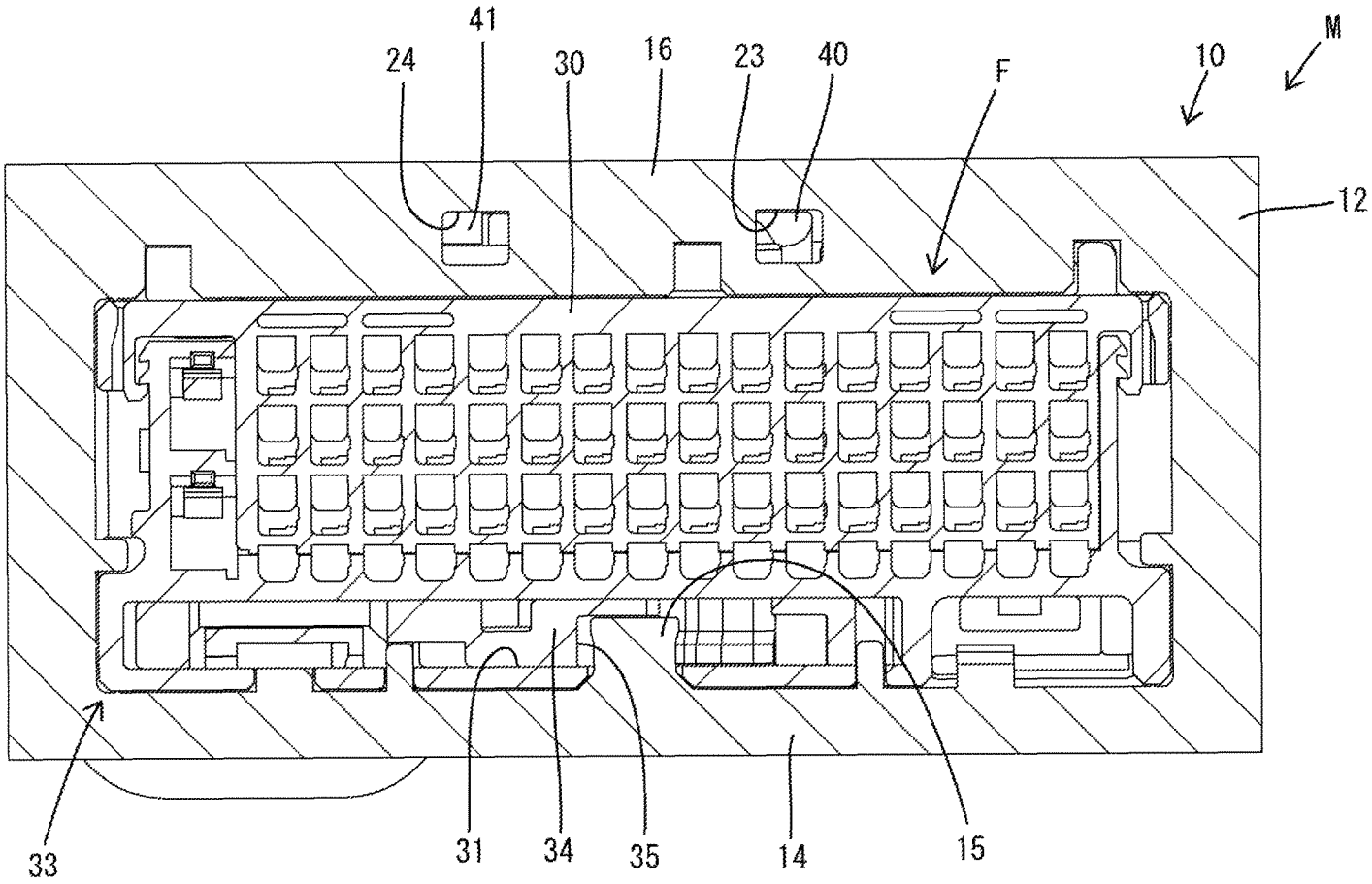
FIG. 5 is a section along C-C of FIG. 3.
Figure 6:
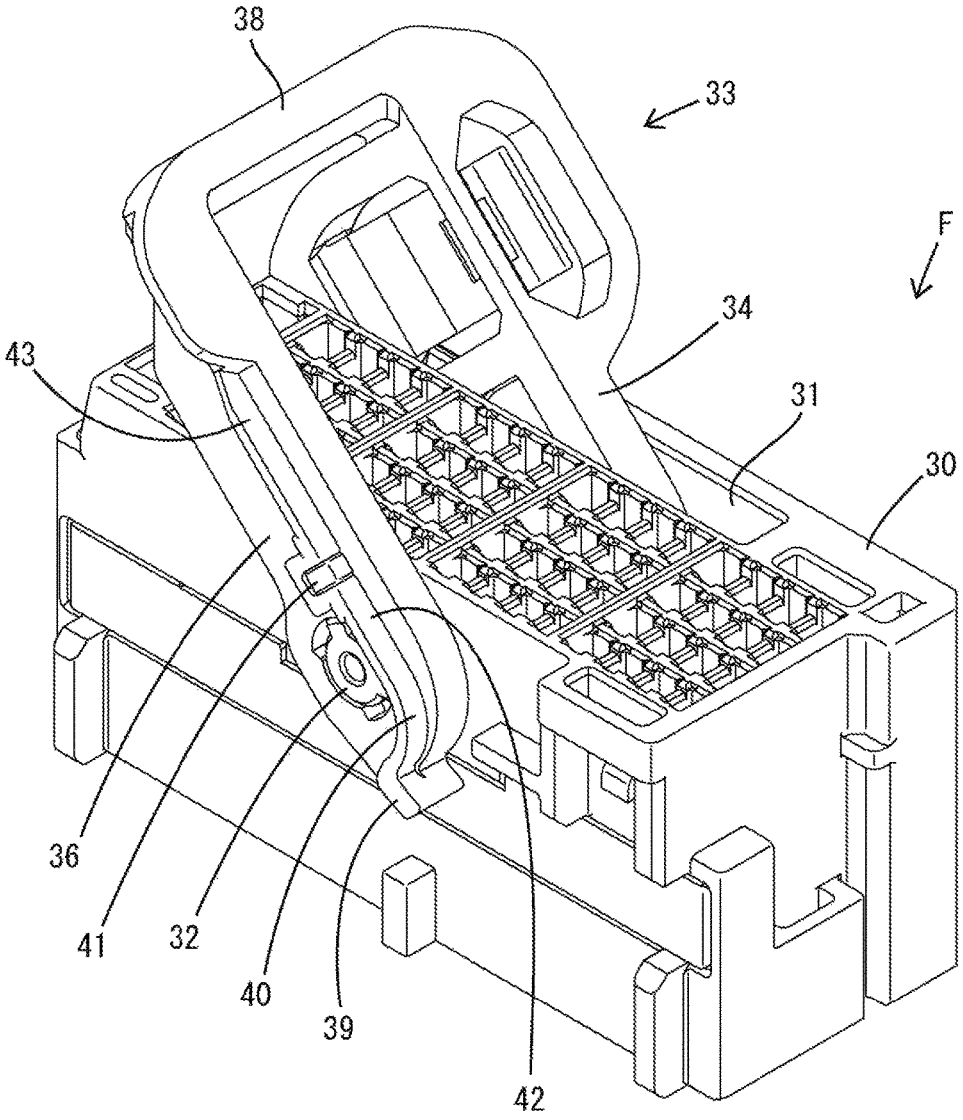
FIG. 6 is a perspective view of the female connector showing a state where the lever is at an initial position.
Figure 7:
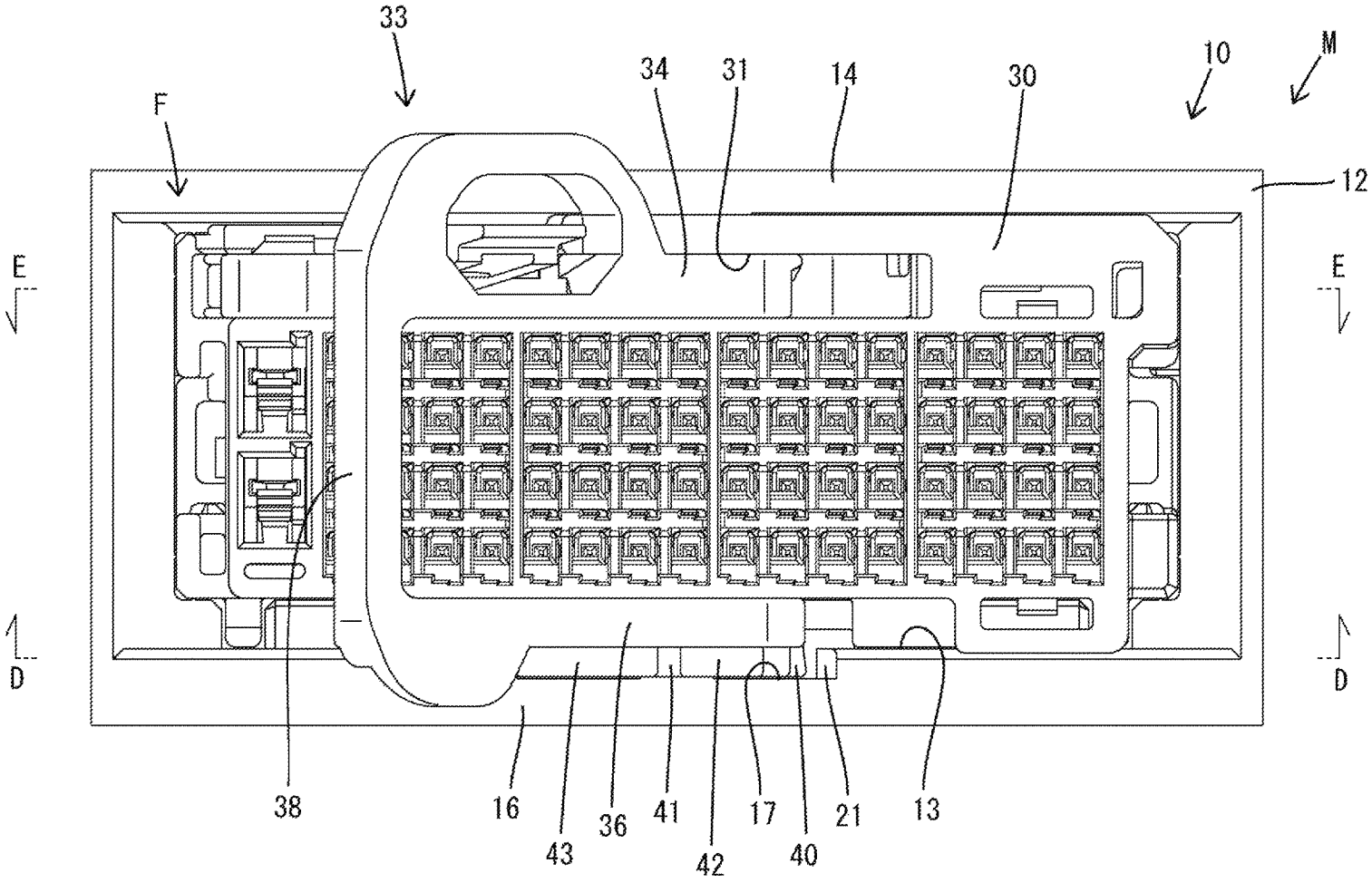
FIG. 7 is a plan view showing a state where the lever is at the initial position and the male and female connectors are slightly connected.
Figure 8:
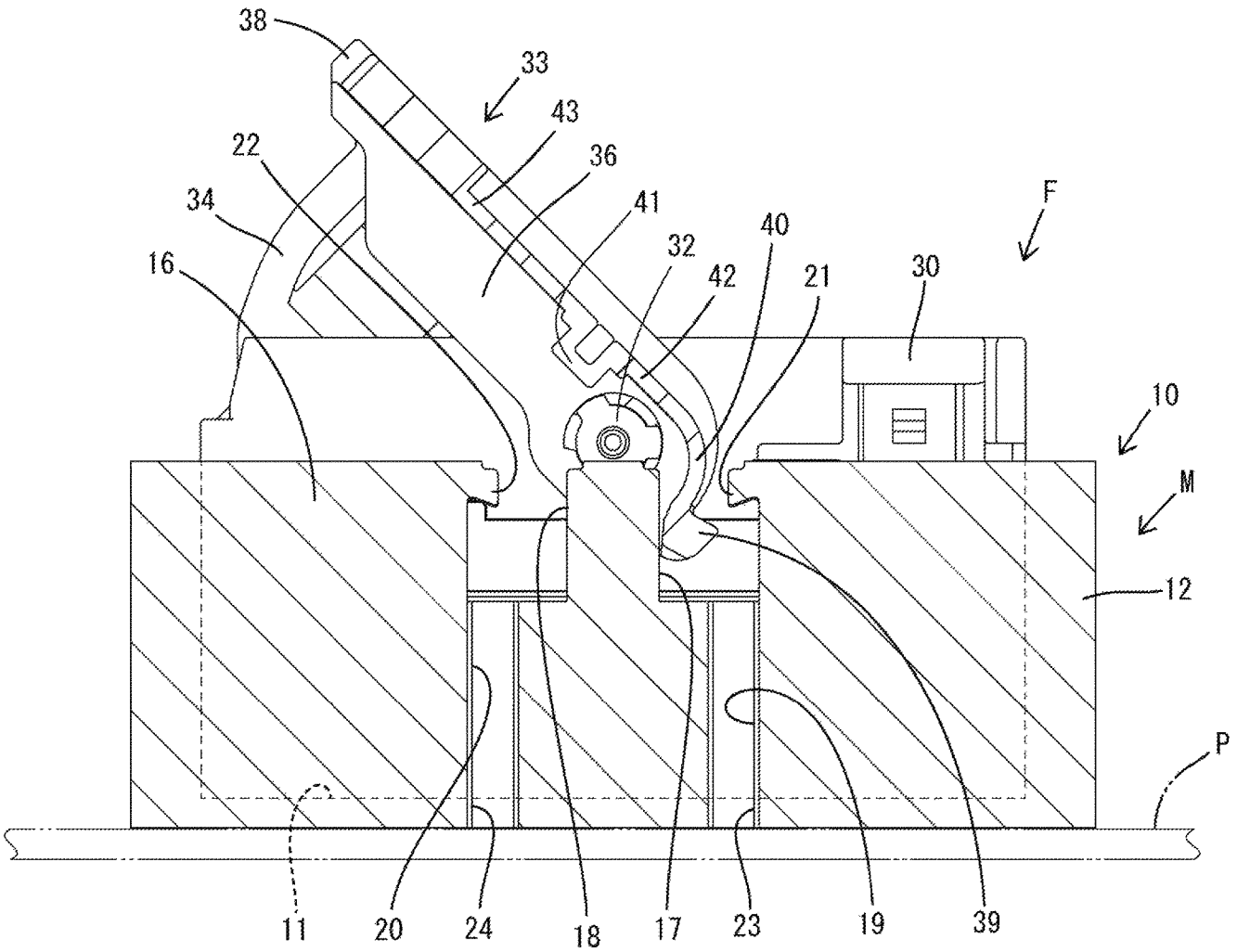
FIG. 8 is a section along D-D of FIG. 7.
Figure 9:
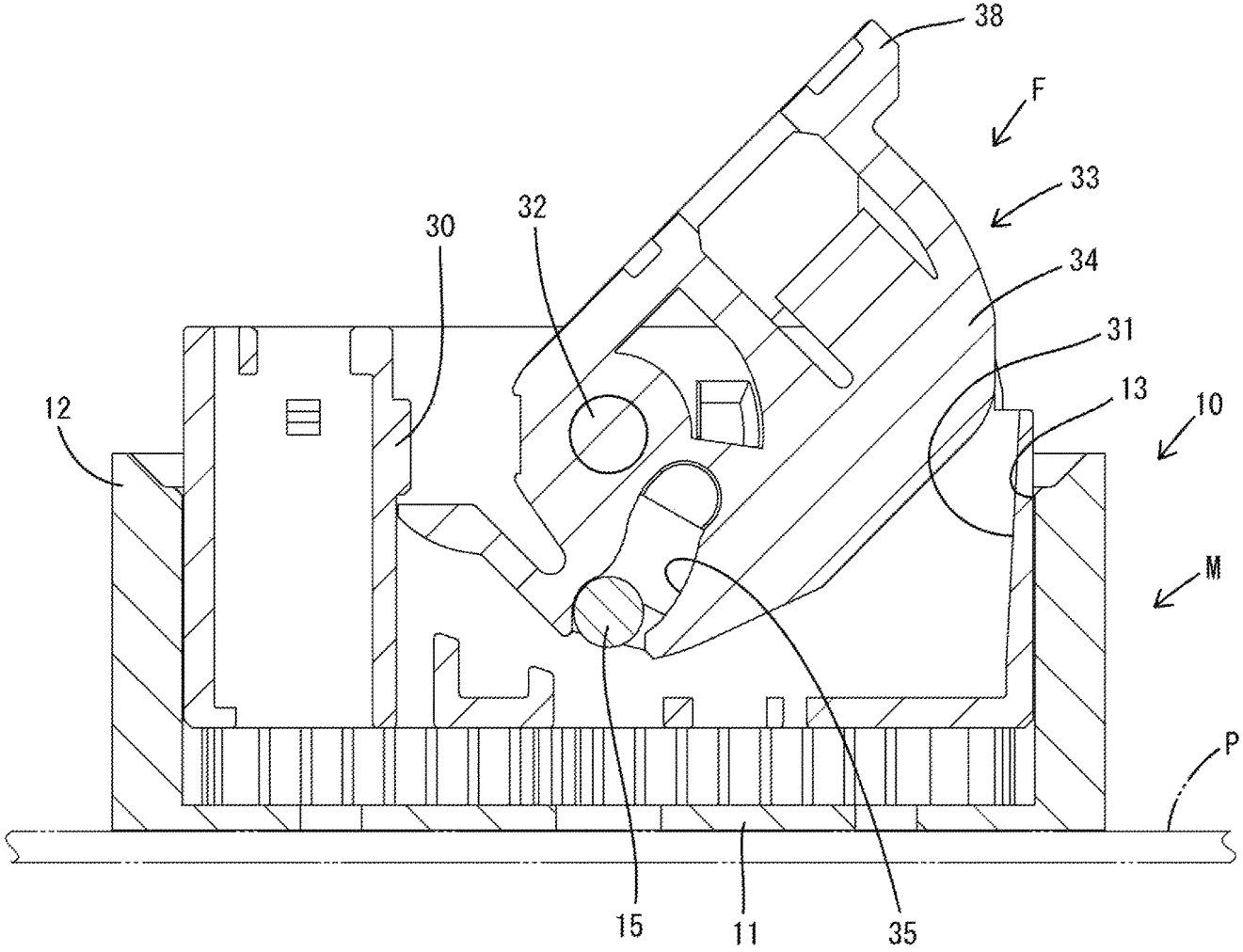
FIG. 9 is a section along E-E of FIG. 7.
Figure 10:
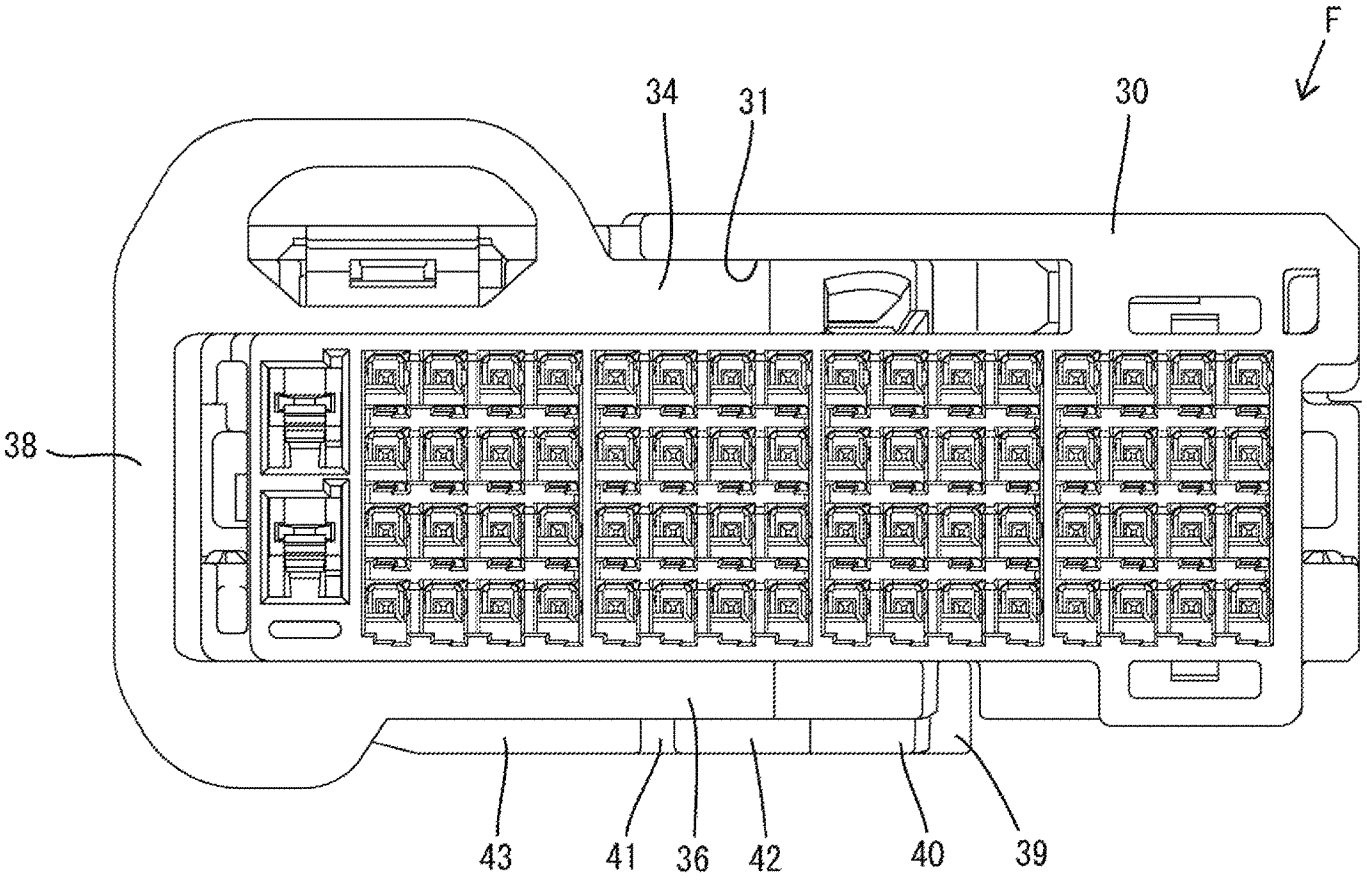
FIG. 10 is a plan view of the female connector showing the state where the lever is at the connection position.

One specific embodiment of the invention is described with reference to FIGS. 1 to 14. Note that, in the following description, a lower side in FIGS. 2, 7, 10 and 14 is defined as a front concerning a front-rear direction. Upper and lower sides shown in FIGS. 1, 3, 4, 6, 8, 9 and 11 to 13 are defined as upper and lower sides concerning a vertical direction. Left and right sides shown in FIGS. 2, 3, 5, 7, 8, 10 and 11 are defined as left and right sides concerning a lateral direction. In FIGS. 4, 9 and 12, left and right sides are reversed.

A lever-type connector of this embodiment includes a male connector M to be mounted on a surface of a circuit board P and a female connector F connectable to the male connector M. In this embodiment, it is assumed that the circuit board P is disposed horizontally and the surface of the circuit board P is facing up.

<Male Connector M>

The male connector M includes a male housing 10 made of synthetic resin and to be mounted by being placed on the surface of the circuit board P, and long and thin straight male terminal fittings 25 mounted in the male housing 10.

The male housing 10 includes a horizontal bottom or back wall 11 to be arranged to face the circuit board P or arranged in surface contact with the circuit board P, and a receptacle 12 in the form of a rectangular tube extending forward (up direction in this embodiment) from the outer periphery of the bottom wall 11. The male terminal fitting 25 is mounted to penetrate through the bottom wall 11 vertically, an upper end area of the mal terminal fitting 25 is accommodated in the receptacle 12 and a lower end part of the male terminal fitting 25 is connected to the circuit board P below the bottom wall 11.

Figure 14:
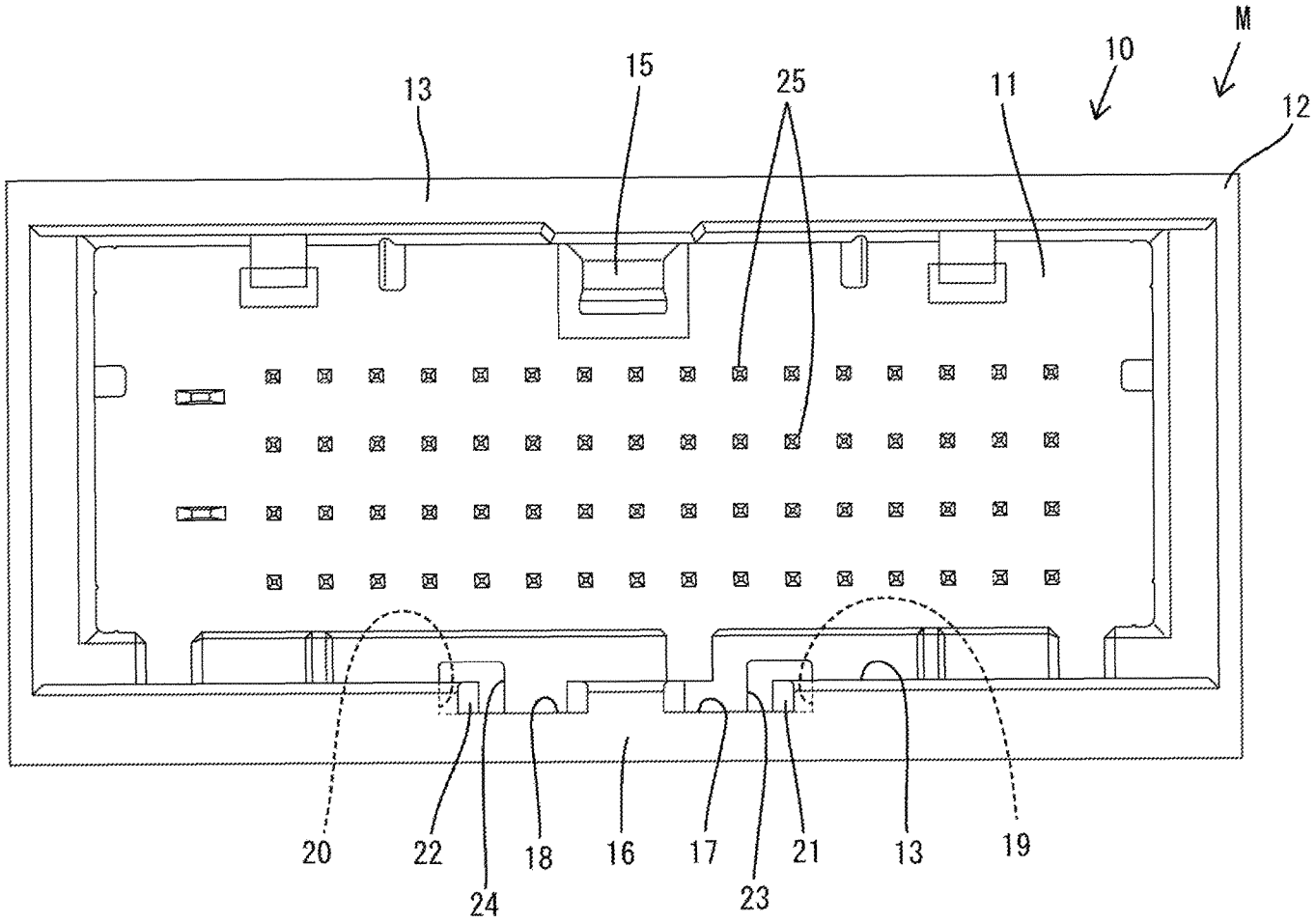
FIG. 14 is a plan view of the male connector.

The entire area of the upper end of the receptacle 12 is open as an upper or front opening 13. A cam follower 15 projects on the inner surface of a rear wall 14 constituting a peripheral wall portion. As shown in FIGS. 3, 8 and 14, first and second guiding grooves 17 extend from the upper opening 13 toward the bottom wall 11. The second guiding groove 18 (communication groove) is arranged to the left of the first guiding groove 17 and extends from the upper surface opening 13 toward the bottom wall 11 are bilaterally symmetrically formed in the inner surface of a front wall 16 constituting the peripheral wall portion.

As shown in FIGS. 3 and 8, first and second mold removal grooves 19 and 20 are formed bilaterally symmetrically in the inner surface of the front wall 16. The first mold removal groove 19 communicates with an area of the first guiding groove 17 excluding an upper end part facing the upper surface opening 13. The second mold removal groove 20 is a communication groove that is arranged to the left of the first mold removal groove 19 and communicates with an area of the second guiding groove 18 excluding an upper end part facing the upper surface opening 13. A vertical formation area of the first and second mold removal grooves 19, 20 extends from a position slightly below the upper surface opening 13 to the position of the bottom wall 11.

First and second receiving portions 21 and 22 are formed bilaterally symmetrically on an upper end part of the inner surface of the front wall 16 near the upper surface opening 13. The first receiving portion 21 faces the upper end of the first mold removal groove 19 and the second receiving portion 22 is to the left of the first receiving portion 21. The first and second receiving portions 21, 22 engage a correcting projection 39 of a lever 33 to be described later to correct the posture inclination of the both connectors F, M.

First and second through holes 23 and 24 are formed bilaterally symmetrically in the bottom wall 11. The first through hole 23 vertically faces the first receiving portion 21 and the second through hole 24 vertically faces the second receiving portion 22. The first through hole 23 communicates with the upper surface opening 13 of the receptacle 12 via the first guiding groove 17 and the first mold removal groove 19. This enables the first through hole 23 to be seen via the first guiding groove 17 and the first mold removal groove 19 when the receptacle 12 is viewed from a front surface side. Thus, the first guiding groove 17 and the first mold removal groove 19 can serve as an external matter intrusion path extending from the upper surface opening 13 of the receptacle 12 to the first through hole 23.

The second through hole 24 communicates with the upper surface opening 13 of the receptacle 12 via the second guiding groove 18 and the second mold removal groove 20. Thus, the second through hole 24 can be seen via the second guiding groove 18 and the second mold removal groove 20 when the receptacle 12 is viewed from the front. The second guiding groove 18 and the second mold removal groove 20 can serve as an external matter intrusion path extending from the upper surface opening 13 of the receptacle 12 to the second through hole 24.

<Female Connector F>

The female connector F includes a female housing 30 made of synthetic resin, female terminal fittings (not shown) and the lever 33 made of synthetic resin. The female housing 30 is in the form of a block and the female terminal fittings are accommodated inside. The female housing 30 is formed with a slit-like accommodation space 31 open on and laterally extending along the rear end of the upper surface of the female housing 30. Two support shafts 32 are formed on the front surfaces of the accommodation space 31 and the female housing 30.

The lever 33 is a single component including a plate-like cam functioning portion 34, an arm 36 and an operating portion 38. The cam functioning portion 34 has a plate thickness direction aligned with a front-rear direction and is formed with a cam groove 35. The arm 36 is a long and narrow plate whose plate thickness direction is aligned with the front-rear direction. The cam functioning portion 34 is accommodated into the accommodation space 31 and the arm 36 is arranged along the front surface of the female housing 30.

The lever 33 is rotatable between an initial position (see FIGS. 1 to 4, 10 and 11) and a connection position (see FIGS. 6 to 9) with respect to the female housing 30 by fitting bearing holes 37 of the cam functioning portion 34 and the arm 36 to the support shafts 32. The operating portion 38 is located to the left of the bearing holes 37 and couples end parts of outer edge parts of the cam functioning portion 34 and the arm 36 most distant from the bearing holes 37.

In connecting the connectors F, M, the female housing 30 is fit shallowly into the receptacle 12 from above the male connector M, and the cam follower 15 enters the cam groove 35 with the lever 33 located at the initial position. The lever 33 then is rotated toward the connection position by gripping the operating portion 38, and a cam action between the cam follower 15 and the cam groove 35 pulls the female connector F toward the male connector M. The connectors F, M are connected properly when the lever 33 reaches the connection position.

The arm 36 is arranged in a clearance between the front surface of the female housing 30 and the front wall 16 of the receptacle 12 in the process of connecting the connectors F, M and with the connectors F, M properly connected, and at least a part of the arm 36 is accommodated together with the female housing 30 inside the receptacle 12. In the process of connecting the connectors F, M, an end part of the arm 36 opposite the operating portion 38 and close to the bearing holes 37 is displaced at a position near the first guiding groove 17, the first mold removal groove 19 and the first receiving portion 21.

The correcting projection 39 is formed on an end part of the arm 36 opposite to the operating portion 38. The correcting projection 39 projects from the outer peripheral edge of the arm 36 in a direction away from the operating portion 38 and toward the front 16 of the receptacle 12. The correcting projection 39 is in the first guiding groove 17 when the lever 33 is at the initial position and the female housing 30 is inserted shallowly in the receptacle 12. The correcting projection 39 approaches the first receiving portion 21 when the lever 33 is rotated toward the connection position from this state.

The correcting projection 39 is locked to the first receiving portion 21 by contacting the first receiving portion 21 from below (side of the bottom wall 11) immediately before the lever 33 reaches the connection position. At this time, the female housing 30 is in a posture inclined slightly rearward with respect to the male housing 10 (i.e. in such a posture that a front side of the female housing 30 is lifted slightly with respect to the male housing 10). This inclination is caused by the engagement of the cam groove 35 of the lever 33 and the cam follower 15 of the receptacle 12 only on rear sides of the housings 10, 30.

The lever 33 is rotated farther from the state where the correcting projection 39 is locked to the first receiving portion 21 to reach the connection position. In this process, the posture inclination of the female housing 30 is corrected by a lever action with a contact part between the correcting projection 39 and the first receiving portion 21 serving as a fulcrum, the operating portion 38 serving as a point of force and a fit part of the bearing hole 37 of the arm 36 and the support shaft 32 serving as a point of action. The correcting projection 39 projects from the outer surface of the arm 36 toward the front surface wall 16 of the receptacle 12, and the outer surface of the arm 36 and the inner surface of the front surface wall 16 are separated by a projecting dimension of the correcting projection 39 in an area corresponding to the first guiding groove 17. Further, the correcting projection 39 is located below the first receiving portion 21 with the connectors F, M connected properly, and the first through hole 23 communicates with the first guiding groove 17 via the first mold removal groove 19.

If the first guiding groove 17 is open to the outside (upper side) of the receptacle 12 in the upper surface opening 13, an external matter that may have intruded into the first guiding groove 17 may pass through the first through hole 23 via the first mold removal groove 19 and may reach the surface of the circuit board P. Accordingly, in this embodiment, the arm 36 is formed with a first closing portion 40 to prevent such intrusion of external matter.

Figure 11:
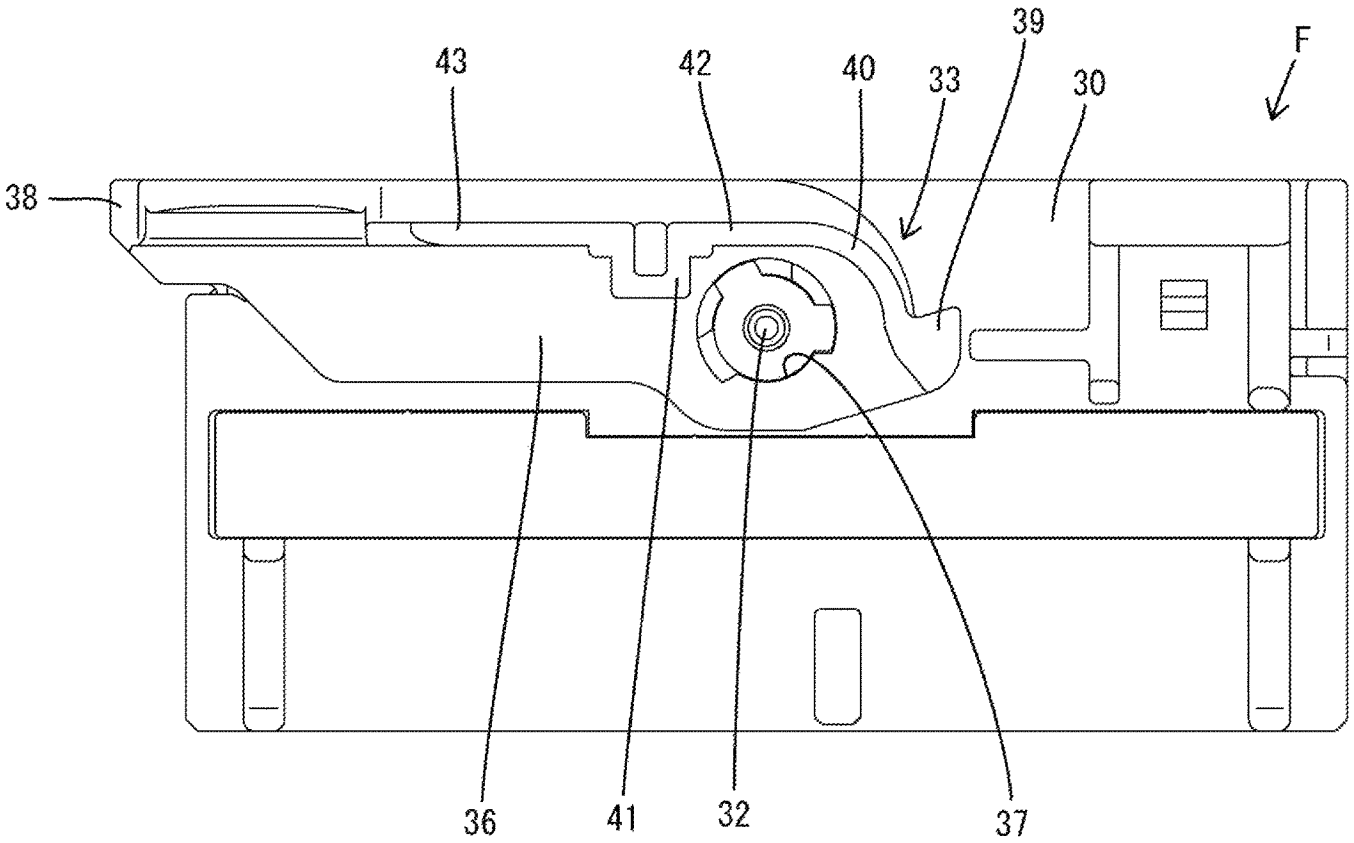
FIG. 11 is a front view of the female connector showing the state where the lever is at the connection position.
Figure 12:
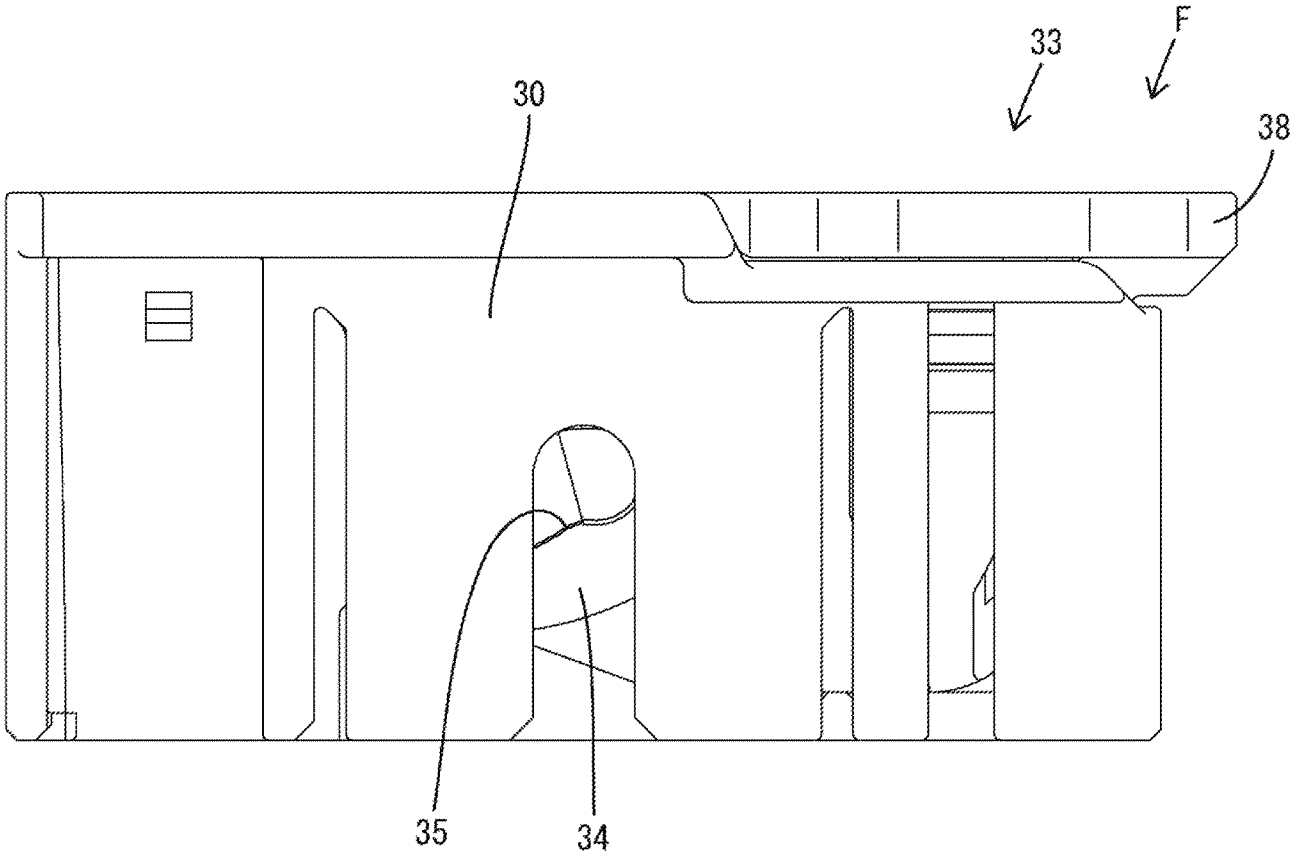
FIG. 12 is a back view of the female connector showing the state where the lever is at the connection position.
Figure 13:
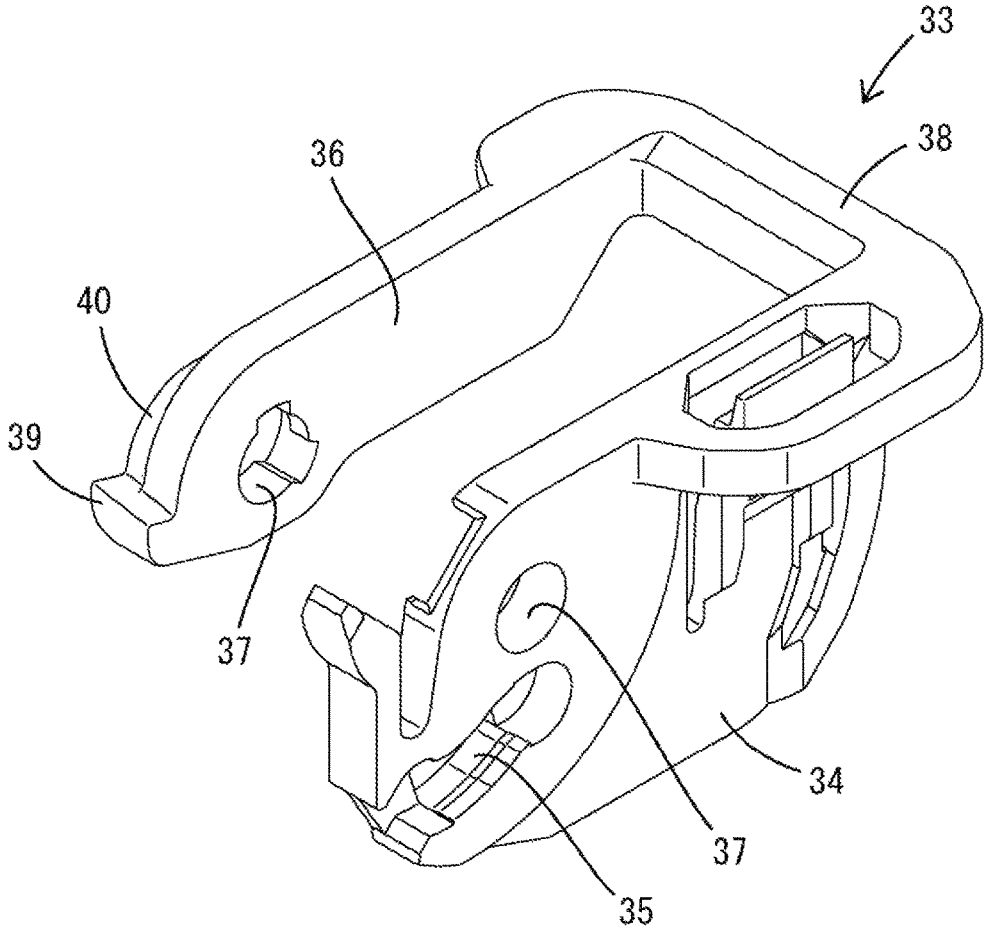
FIG. 13 is a perspective view of the lever.

The first closing portion 40 is in the form of a rib projecting from the front surface of the arm 36 toward the front wall 16 and has a substantially quarter-circular shape when viewed from the front, as shown in FIGS. 8 and 11. A right end part of the first closing portion 40 in a length direction is connected to the correcting projection 39. The entire area of the first closing portion 40 in the length direction is in an area separated from the outer peripheral edge of the arm 36 toward the bearing hole 37 (down when the lever 33 is at the connection position).

The first closing portion 40 is closer to the front surface of the receptacle 12 than the first through hole 23 and is accommodated in the first guiding groove 17 when the connectors F, M are connected properly. The first closing portion 40 closes a clearance between the arm 36 and the front wall 16 in the upper surface opening 13, thereby preventing external matter from intruding into the receptacle (first mold removal groove 19) through the clearance between the arm 36 and the front wall 16.

Further, the outer surface of the arm 36 and the inner surface of the front wall 16 are separated by the projecting dimension of the correcting projection 39 in an area corresponding to the second guiding groove 18 when the connectors F, M are connected properly. Further, since no other member is present in the second guiding groove 18 and the second mold removal groove 20 when the connectors F, M are connected properly, the second through hole 24 communicates with the second guiding groove 18 via the second mold removal groove 20.

External matter that has intruded into the second guiding groove 18 could pass through the second through hole 24 via the second mold removal groove 20 and could reach the surface of the circuit board P if the second guiding groove 18 is open to the outside of the receptacle 12 in the upper surface opening 13. Accordingly, the arm 36 of this embodiment is formed with a second closing portion 41 to prevent such intrusion.

The second closing portion 41, like the first closing portion 40, is in the form of a rib projecting from the outer surface of the arm 36 toward the front wall 16. The second closing portion 41 has a rectangular shape when viewed from the front with an open upper surface, as shown in FIGS. 3 and 11. The second closing portion 41 is entirely in an area separated from the outer peripheral edge of the arm 36 toward the bearing hole 37 (down when the lever 33 is at the connection position).

A lower part of the second closing portion 41 is fit in the second guiding groove 18 and closes the clearance between the arm 36 and the front wall 16 when the connectors F, M are connected properly. Thus, external matter cannot intrude through the upper opening 13 and into the receptacle 12 (second mold removal groove 20) through the clearance between the arm 36 and the front wall 16.

The arm 36 is formed with a first extending portion 42 connected to the first and second closing portions 40, 41 and a second extending portion 43 connected to the second closing portion 41. The first extending portion 42 is a rib projecting from the front surface of the arm 36 and is horizontal at a position below the upper edge of the arm 36 when the connectors F, M are connected properly. A right end part of the first extending portion 42 extends smoothly and tangentially to a left end part of the first closing portion 40. A left end part of the first extending portion 42 is connected at a substantially right angle to a right-upper part of the second closing portion 41.

The second extending portion 43 is in the form of a rib projecting from the front surface of the arm 36 and is horizontal at a position below the upper edge of the arm 36 when the connectors F, M are connected properly. A right end part of the second extending portion 43 is connected substantially at a right angle to a left-upper end part of the second closing portion 41. A left end part of the second extending portion 43 is connected to the operating portion 38. Thus, the first and second extending portions 42, 43 are arranged over a relatively long area in the length direction of the arm 36. The first and second extending portions 42, 43 proximately face or contact the front end surface of the front wall 16 when the connectors F, M are connected properly.

As described above, the lever-type connector includes the male housing 10, the female housing 30 and the lever 33 mounted on the female housing 30. The male housing 10 includes the bottom wall 11 formed with the first and second through holes 23, 24, the receptacle 12 extending up from the outer periphery of the bottom wall 11 and the cam follower 15 formed on the inner surface of the receptacle 12. The female housing 30 can be accommodated into the receptacle 12. The lever 33 connects the male and female housings 10, 30 by being rotated from the initial position to the connection position while being engaged with the cam follower 15.

Further, the arm 36 of the lever 33 is between the outer surface of the female housing 30 and the inner surface of the receptacle 12 (front wall 16). The arm 36 is formed with the first and second closing portions 40, 41. The first closing portion 40 is arranged on the front surface side of the first through hole 23 to close the clearance between the upper surface opening 13 of the receptacle 12 and the arm 36 of the lever 33 when the lever 33 is at the connection position.

The second closing portion 41 is arranged in front of the second through hole 24 to close the clearance between the upper opening 13 of the receptacle 12 and the arm 36 of the lever 33 when the lever 33 is at the connection position. As just described, the first closing portion 40 is present in front of the first through hole 23 and is configured to close the clearance between the upper opening 13 of the receptacle 12 and the lever 33. Additionally, the second closing portion 41 is in front of the second through hole 24 and is configured to close the clearance between the upper opening 13 of the receptacle 12 and the lever 33. Thus, external matter cannot intrude into the receptacle 12.

Further, the first receiving portion 21 projects from the inner surface of the receptacle 12. Additionally, the correcting projection 39 is formed on the outer surface of the arm 36 and is configured to correct the posture of the female housing 30 with respect to the male housing 10 by being locked to the first receiving portion 21. The first closing portion 40 is connected to and reinforces the correcting projection 39. Further, rigidity of the first closing portion 40 is enhanced by the arcuate shape so that the first closing portion 40 is excellent at reinforcing the correcting projection 39.

The inner surface of the front wall 16 of the receptacle 12 has the first mold removal groove 19 for forming the first receiving portion 21. The first mold removal groove 19 communicates with the first through hole 23 and the first guiding groove 17. Thus, the first guiding groove 17 constitutes a path for moving the correcting projection 39 toward the back surface (lower side) of the first receiving portion 21 from the upper opening 13 of the receptacle 12.

Thus, an external matter intrusion path extends from the upper surface opening 13 of the receptacle 12 to the first through hole 23 via the first guiding groove 17 and the first mold removal groove 19. However, the first closing portion 40 is accommodated in the first guiding groove 17 when the connectors F, M are connected properly and the lever 33 is at the connection position. Accordingly, the first closing portion 40 remains in the first guiding groove 17 even if the arm 36 is displaced slightly up toward the front surface with respect to the receptacle 12 when the lever 33 is at the connection position. Therefore, external matter cannot intrude into the receptacle 12.

The left end part of the arm 36 most distant from a center of rotation (bearing hole 37) of the arm 36 serves as the operating portion 38 for rotating the lever 33. The rib-like first and second extending portions 42, 43 project toward the operating portion 38 from the outer front surface of the arm 36 and are connected to the first and second closing portions 40, 41. According to this configuration, the entire arm 36 is reinforced and the first and second closing portions 40, 41 also are reinforced by the rib-like first and second extending portions 42, 43.

Further, the second guiding groove 18 and the second mold removal groove 20 are formed in the inner surface of the front wall 16 of the receptacle 12 and allow communication between the upper opening 13 of the receptacle 12 and the second through hole 24. Additionally, the second closing portion 41 is accommodated in the second guiding groove 18 when the lever 33 is at the connection position. According to this configuration, an external matter intrusion path extending from the upper opening 13 of the receptacle 12 to the second through hole 24 may be formed via the second guiding groove 18 and the second mold removal groove 20. However, even if the arm 36 is displaced slightly up toward the front with respect to the receptacle 12 when the lever 33 is at the connection position, the second closing portion 41 remains in the second guiding groove 18 so that external matter cannot intrude into the receptacle 12.

The invention is not limited to the above described and illustrated embodiment. For example, the following embodiments are also included in the scope of the invention.

Although the first closing portion is connected to the correcting projection in the above embodiment, the closing portion may be separated from the correcting projection. In this case, the first closing portion may not be accommodated into the guiding groove.

Although the first closing portion connected to the correcting projection is arcuate in the above embodiment, the first closing portion may be straight.

Although the entire area of the first closing portion in the length direction is arranged at the position separated in from the outer peripheral edge of the arm in the above embodiment, at least a part of the first closing portion may be arranged along the outer peripheral edge of the arm.

Although the second closing portion is entirely at the position separated inward from the outer peripheral edge of the arm in the above embodiment, the second closing portion may be adjacent to the outer peripheral edge of the arm.

Although the entire area of the extending portion in the length direction is arranged at the position separated inwardly from the outer peripheral edge of the arm in the above embodiment, at least a part of the extending portion may be arranged along the outer peripheral edge of the arm.

Although the arm has the extending portions in the above embodiment, but may be formed with no extending portion.

The lower surface (back surface) of the bottom wall of the male connector faces or is in surface contact with the circuit board in the above embodiment. However, the invention can be applied in the case where the back surface of the back wall is at a right angle to the circuit board.

The lever-type connector is mounted on the circuit board in the above embodiment. However, the invention can be applied also to a lever-type connector that is not to be mounted on a circuit board (e.g. such a lever-type connector that male terminal fittings of a male connector are connected to wires).

LIST OF REFERENCE SIGNS

10 . . . male housing
11 . . . bottom wall
12 . . . receptacle
13 . . . upper opening
15 . . . cam follower
17 . . . first guiding groove (guiding groove)
18 . . . second guiding groove (communication groove)
19 . . . first mold removal groove (mold removal groove)
20 . . . second mold removal groove (communication groove)
21 . . . first receiving portion
23 . . . first through hole
24 . . . second through hole
30 . . . female housing
33 . . . lever
36 . . . arm
38 . . . operating portion
39 . . . correcting projection
40 . . . first closing portion
41 . . . second closing portion
42 . . . first extending portion
43 . . . second extending portion

What is claimed is:

1. A lever-type connector, comprising:

a male housing including opposite front and rear ends, a back wall formed at the rear end, opposed first and second walls extending forward from the back wall to the front end and defining a receptacle extending from the front end to the back wall, a cam follower formed on an inner surface of the first wall and projecting into the receptacle, and at least one guiding groove formed on an inner surface of the second wall and continuing from the front end through the back wall;

a female housing configured to be accommodated into the receptacle, the female housing having opposite first and second surfaces formed respectively with first and second support shafts;

a lever having first and second arms mounted respectively on the first and second support shafts of the female housing, a cam groove formed in the first arm and configured to connect the male housing and the female housing by rotating the lever from an initial position to a connection position while the cam groove is engaged with the cam follower;

the second arm being arranged between the second surface of the female housing and the inner surface of the second wall of the receptacle; and a closing portion formed on the second arm and configured to close a clearance between a front opening of the guiding groove and the lever by being arranged in front of the guiding groove when the lever is at the connection position.

2. The lever-type connector of claim 1, further comprising:

a receiving portion projecting from the inner surface of the receptacle; and a correcting projection formed on an outer surface of the arm and configured to correct a posture of the female housing with respect to the male housing by being locked to the receiving portion, wherein the closing portion is connected to the correcting projection.

3. The lever-type connector of claim 2, wherein the closing portion is arcuate.

4. The lever-type connector according to claim 2, wherein the closing portion is accommodated in the guiding groove when the lever is at the connection position.

5. The lever-type connector of claim 1, further comprising:

an operating portion at an end of the first and second arms most distant from a center of rotation of the arms, the operating portion being configured to rotate the lever; and a rib-like extending portion formed on an outer surface of the arm connected to the closing portion and extending toward the operating portion.

6. The lever-type connector of claim 1, wherein the closing portion is accommodated in the guiding groove when the lever is at the connection position.

7. The lever-type connector of claim 1, wherein the second arm of the lever has no cam groove.

8. The lever-type connector of claim 1, wherein the second wall of the male housing has no cam follower.

9. The lever-type connector of claim 1, wherein the at least one guide groove on the inner surface of the second wall comprises first and second guide grooves.

10. The lever-type connector of claim 1, wherein the second support shaft is between the back wall and the closing portion when the lever is in the connection position.

11. The lever-type connector of claim 1, wherein the closing portion is between the second support shaft and the front end of the male housing when the lever is in the connection position.

* * * * *